United States Patent [19]

Heimberger

[11] 3,964,135

[45] June 22, 1976

[54] SLIDE-FASTENER HALVES

[75] Inventor: Helmut Heimberger, Grenzach, Germany

[73] Assignee: Opti-Holding AG, Glarus, Switzerland

[22] Filed: May 31, 1974

[21] Appl. No.: 475,263

Related U.S. Application Data

[62] Division of Ser. No. 381,441, July 23, 1973, Pat. No. 3,884,168.

[30] Foreign Application Priority Data

July 21, 1972 Germany ..... 2235828

[52] U.S. Cl. ..... 24/205.1 C; 24/205.16 C

[51] Int. Cl.[2] ..... A44B 19/12; A44B 19/40

[58] Field of Search ..... 24/205.1 C, 205.13 C, 24/205.16 C

[56] References Cited

UNITED STATES PATENTS

| | | | |
|---|---|---|---|
| 3,249,976 | 5/1966 | Burbank | 24/205.1 C |
| 3,283,379 | 11/1966 | Burbank | 24/205.1 C |
| 3,665,561 | 5/1972 | Heimberger | 24/205.1 C |
| 3,768,125 | 10/1973 | Frohlich | 24/205.16 C |

FOREIGN PATENTS OR APPLICATIONS

| | | | |
|---|---|---|---|
| 1,253,944 | 11/1967 | Germany | 24/205.16 C |
| 1,237,837 | 6/1969 | United Kingdom | 24/205.16 C |

*Primary Examiner*—Bernard A. Gelak
*Attorney, Agent, or Firm*—Karl F. Ross; Herbert Dubno

[57] ABSTRACT

A preformed multiturn coupling element of the helical-coil or meander type is juxtaposed with a tape and a loop is formed by a stitching thread whose needle is thrust upwardly between each pair of turns. A gripper engages the loop and draws it laterally out of the coupling element to reintroduce it between another pair of turns where it is engaged by another loop thrust through the tape. In one embodiment the thread passes through the tape and an overlying filler cord, its loops being drawn half-way around that cord and being interlinked at points between the cord and the tape.

3 Claims, 6 Drawing Figures

SLIDE-FASTENER HALVES

Cross-Reference to Related Application

This application is a division of my copending application Ser. No. 381,441 filed 23 July 1973, now U.S. Pat. No. 3,884,168.

FIELD OF THE INVENTION

My present invention relates to a slide-fastener half of the type wherein a monofilamentary coil is stitched onto a supporting stringer tape and is longitudinally traversed by a filler cord passing through its turns.

BACKGROUND OF THE INVENTION

In my prior application identified above, I have disclosed and claimed a method of fastening a monofilament coil of helical or meandering type to a stringer tape by a chain stitch, with lateral extraction of each loop of the stitching thread from between adjoining turns of the coil to enable that loop to be swung under the next-succeeding turn. The thread, passing through the filler cord at axially spaced locations, secures the cord to the tape and thereby indirectly fastens the coil in position thereon.

OBJECT OF THE INVENTION

The object of my present invention is to provide an improved slide-fastener half based upon the technique just described.

SUMMARY OF THE INVENTION

In a slide-fastener half according to my present invention, the loops of the stitching emerge at longitudinally spaced locations from the top of the filler cord and pass approximately half-way around that cord to points between the cord and the stringer tape where they are interlinked to form a chain stitch.

Advantageously, the loops embrace the cord on its side remote from the working edge of the tape, i.e. the edge which is overhung by the coupling heads of the coil turns.

BRIEF DESCRIPTION OF THE DRAWING

The above and other features of my present invention will now be described in detail with reference to the accompanying drawing in which.

SPECIFIC DESCRIPTION

Figure 1:
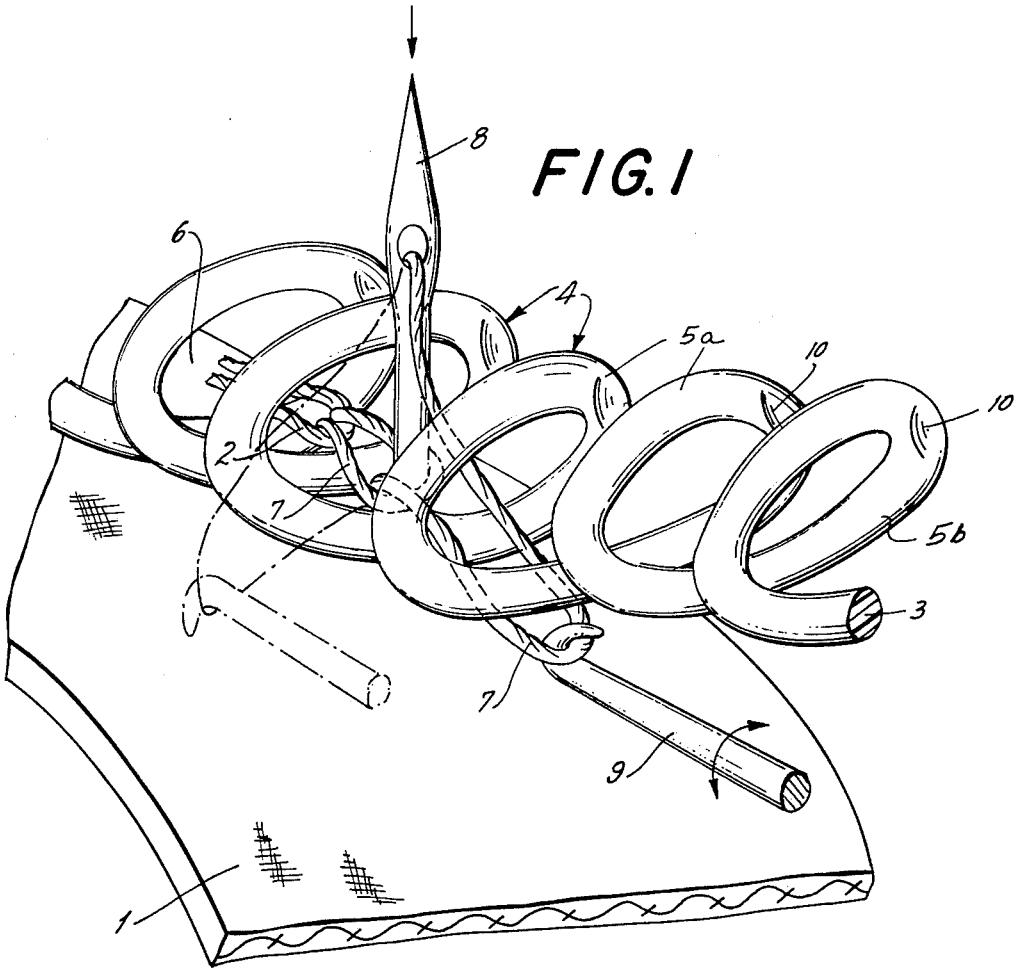
FIG. 1 is a perspective view illustrating the method of making a slide-fastener half according to my prior application identified above.
Figure 2:
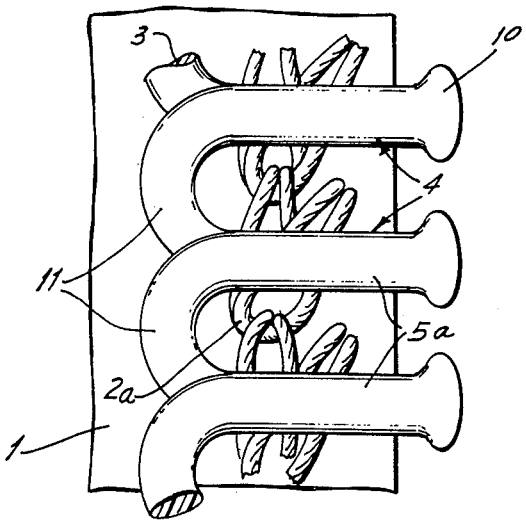
FIG. 2 is a top view of a slide-fastener half made by the method of FIG. 1.
Figure 4:
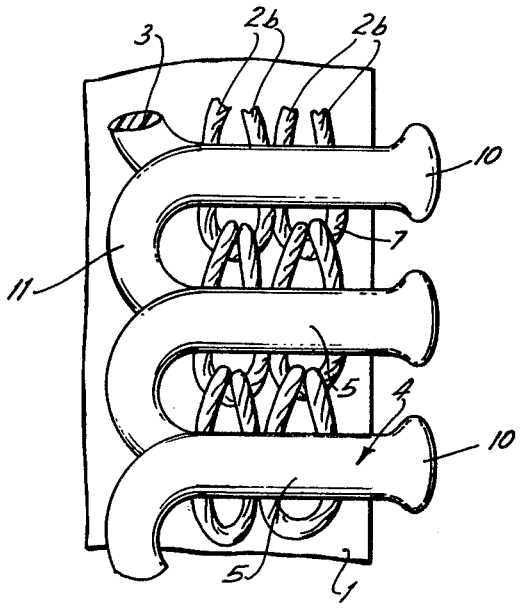
FIGS. 4 and 5 are top views of modified slide-fastener halves made by the method of FIG. 1.
Figure 5:
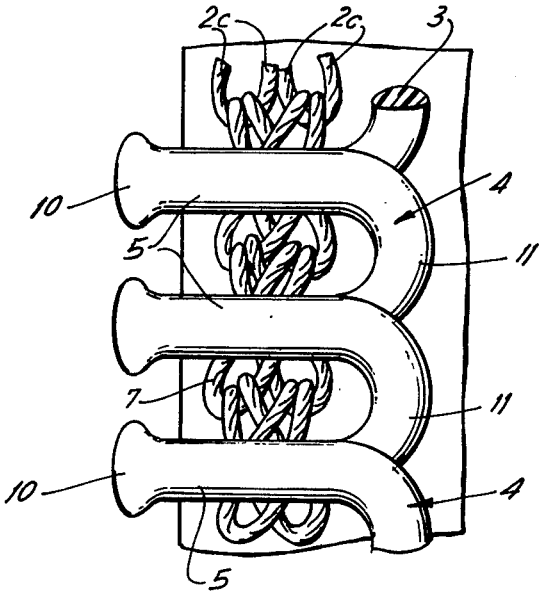

As shown in FIGS. 1 and 2, a slide-fastener half comprises a stringer tape 1 supporting a preformed polyamide monofilament 3 with turns 4 having upper shanks 5*a*, lower shanks 5*b*, coupling heads 10, and connecting bights 11 as is well known per se. FIGS. 2, 4 and 5 illustrate how in a projection orthogonal to the plane of the tape 1, the upper shanks 5*a* overlie the lower shanks 5*b*.

The coil 3 is secured to an edge of the tape 1 by successively laying its shanks 5*b* on this tape and piercing the tape 1 with a needle 8 carrying a thread 2. A gripper 9 engages the thread 2 in a manner well known in the art and forms a loop 7 which, as shown in dot-dash lines in FIG. 1, is first drawn out sideways from between the turns 4 and then forward under the shank 5*b* of the next turn while the needle 8 withdraws downwardly. Thereafter, the needle again pierces the textile tape 1 between the next two turns 4 and passes through the loop 7 held by the gripper 9 which then releases this loop and hooks the thread 2 on the needle 8 to form another stitch in the same manner. This method forms a type 203 chain stitch according to Federal Standard No. 751*a* of January 1965.

This method may be expanded by the use of two needles 8 and a single gripper 9 to produce a linkage as shown in FIG. 2 with a double stitchng 2*a*. Two parallel rows of stitching 2*b* can also be used as shown in FIG. 4. The arrangement of FIG. 5 has two rows of stitching 2*c* which cross over each other.

Figure 3:
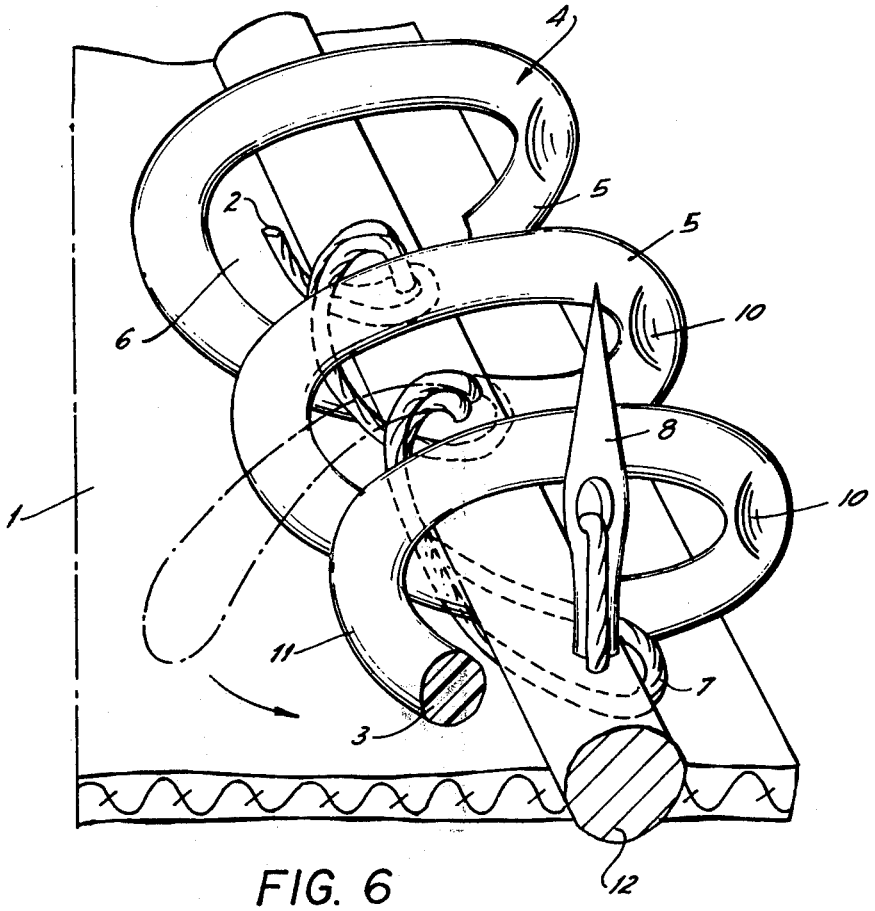
FIG. 3 is another perspective view illustrating a slide-fastener half embodying my present invention.

FIG. 3 shows a slide fastener similar to that of FIG. 1 wherein the coil 13 is provided with a longitudinally throughgoing filler cord 12 pierced by the needle 8 during stitch formation. The individual loops 7 emerge from the cord 12 at the top and pass half-way around the cord, on the side thereof remote from the working edge of the tape 1 which is overhung by the coupling heads 10, to points between the cord and the tape where the loops are interlinked for form a chain stitch as noted above. FIG. 3 also shows that the loops may underlie the lower shanks of turns 5 which, however, are held down by the cord 12 stitched to the tape.

Figure 6:
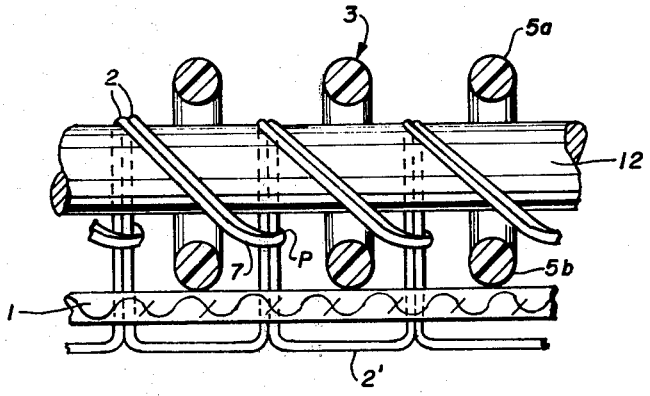
FIG. 6 is a fragmentary longitudinal sectional view of the fastener half shown in FIG. 3.

This has been illustrated more clearly in FIG. 6 which shows the loop-forming thread 2 passing upwardly through the cord 12, descending around the side of the cord to a point P between the cord and the tape 1 where the closed end of the loop comes to rest, and linking up with and adjoining loop rising from that point through the cord. FIG. 6 also shows sections 2′ of the thread passing beneath the tape 1 after having been carried to that level by the descent of needle 8 after the thread projecting from the cord 12 has been engaged by the gripper 9 (FIG. 1). FIGS. 3 and 6 both indicate that the thread 2 remains always below the crests of the turns of monofilament 3 and never crosses its upper shanks 5*a*.

Thus, a slide-fastener made with stringer halves 1, 2, 3, according to this invention, has its stitching 2 completely received within the coil so that the slider will not wear through the stitches as it is displaced along the fastener, thereby giving the fastener a much longer service life. Since a preformed coil is used the production speed is greatly increased as the controlling factor becomes the stitching speed of the sewing apparatus.

I claim:

1. A slide-fastener half comprising:

an elongated stringer tape;

a monofilamentary coil supported on said tape, said coil having turns with lower shanks resting on said tape, upper shanks spaced from said tape and intervening coupling heads overhanging an edge of said tape;

a filler cord extending longitudinally through said coil; and stitching securing said coil to said tape, said stitching consisting of loops of thread emerging at longitudinally spaced locations from the top of said cord and passing underneath said upper shanks approximately half-way around said cord to points between said cord and said tape, said loops being interliked at said points to form a chain stitch.

2. A slide-fastener half as defined in claim 1 wherein at least some of said loops extend between said lower shanks and said tape.

3. A slide-fastener half as defined in claim 1 wherein said loops pass around said cord on a side thereof remote from said edge.

* * * * *